United States Patent [19]

Favreau

[11] Patent Number: 4,832,190

[45] Date of Patent: May 23, 1989

[54] WASHING MACHINE PACKING BRACE AND BLANK THEREFOR

[75] Inventor: Andé Favreau, Boucherville, Canada

[73] Assignee: Domtar Inc., Montreal, Canada

[21] Appl. No.: 232,198

[22] Filed: Aug. 15, 1988

[51] Int. Cl.[4] ..... B65D 85/00

[52] U.S. Cl. ..... 206/320; 206/521; 206/588

[58] Field of Search ..... 206/320, 521, 588

[56] References Cited

U.S. PATENT DOCUMENTS

| | | | |
|---|---|---|---|
| 3,438,482 | 4/1969 | Hamilton | 206/320 |
| 4,240,550 | 12/1980 | Collin | 206/320 |
| 4,700,832 | 10/1987 | Champ | 206/320 |

*Primary Examiner*—Allen M. Ostrager
*Attorney, Agent, or Firm*—Antoine H. Gauvin

[57] ABSTRACT

The packing brace is inserted into washing machines to maintain the agitator, tub and housing of the machine free from movement relative to each other when transporting the machine. A preferred corrugated fiberboard blank produces a box having a top panel extending perpendicularly into a pair of opposite end panels, the latter extending perpendicularly toward each other into a pair of bottom panels. The pair of bottom panels extends perpendicularly toward the top panel into a pair of juxtaposed tuck panels which have locking tabs. The locking tab of each tuck panel is inserted and thereby releasably locked within an elongated aperture in the top panel. The pair of bottom panels and their extending tuck panels each have a cut out portion cooperating to define a box-like opening within the packing brace, the box-like opening having a depth less than the depth of the packing brace. A means to indicate orientation of the packing brace and blank therefor is also disclosed.

20 Claims, 3 Drawing Sheets

Fig. 7
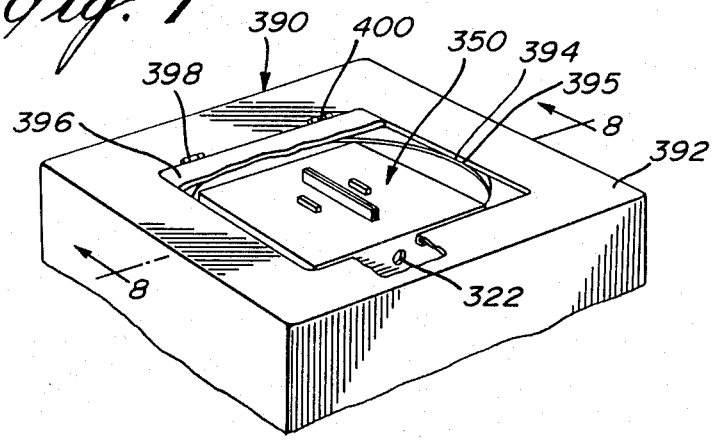
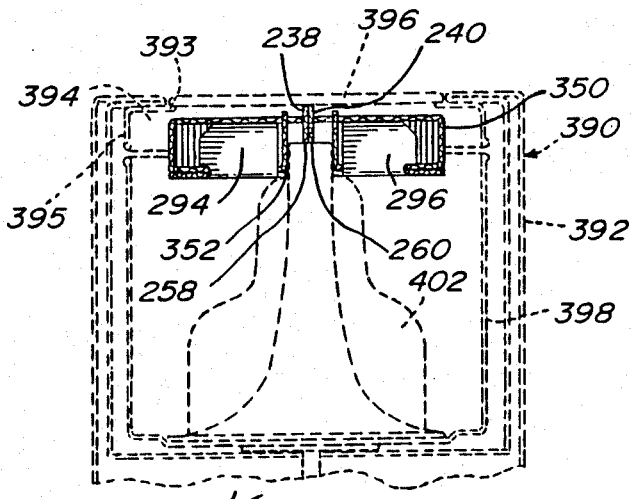
Fig. 8

WASHING MACHINE PACKING BRACE AND BLANK THEREFOR

FIELD OF THE INVENTION

This invention relates to a packing brace for securing the agitator and tub of an automatic washing machine against movement. In particular, this invention relates to a unitary corrugated fibreboard packing brace and blank therefor for securing the agitator and tub to the housing of an automatic washing machine to prevent damage of inner parts during transport or moving.

BACKGROUND OF THE INVENTION

Generally, upright automatic washing machines have inner parts, such as the agitator and tub, which move or are able to move with respect to the housing, during normal operation. The agitator vibrates in a substantially circular motion, reversing direction or remaining stationary, while the tub generally rotates or remains stationary, according to the cycle of the machine. When the machine is not in operation, the agitator and tub generally remain unsecured with respect to the housing and each other. Thereby, upon moving, lifting or transporting the washing machine, the agitator and tub are relatively free to move or vibrate with respect to the housing and each other, in most cases causing damage to the inner parts and the housing.

Various packing braces have been proposed to secure the agitator and tub to the housing. U.S. Pat. No. 3,184,048 dated May 18, 1965 and as invented by V. G. Bjerum teaches an agitator and tub bracing means where four parts of corrugated paper material are assembled together with a flexible tension means. Thus a single packing brace requires the manufacture of several parts and their assembly. U.S. Pat. No. 3,912,076 dated Oct. 14, 1975 and as invented by M. W. Elwell teaches a packing brace consisting of two plastic foam bracing members to be inserted and pressed in position in the washing machine one at a time, thereby requiring more than a one step insertion. Also, these multi-part packing braces sometimes unnoticeably become disassembled prior to and particularly during moving of the washing machine, whereby damages can occur.

In order to overcome these difficulties, it is an object of this invention to provide a readily insertable unitary packing brace and blank therefor to secure the agitator and tub to the housing of the washing machine, to prevent damage of inner parts during shipment or moving.

It is a further object of the invention to provide a packing brace and blank therefor with a means to indicate orientation to enable easier insertion of the packing brace into the washing machine.

BRIEF DESCRIPTION OF THE INVENTION

Broadly stated, the invention is directed to a unitary packing brace for washing machines, for maintaining the agitator, tub and housing of the machine free from movement relative to each other when transporting the machine comprising:

a corrugated fiberboard box having a top surface and a bottom surface, said top surface and said bottom surface being parallel and including a means to maintain said top surface and said bottom surface in spaced relationship, said box through said bottom surface, having a box-like opening, said box-like opening having a bottom-like surface parallel to said top surface and spaced between and away from said top surface and said bottom surface, whereby when said packing brace is inserted into said washing machine through its load opening, said box-like opening fits onto and cooperates with said agitator, said bottom-like surface being supported by said agitator, and said box adapted to snugly engage against the rim of said tub and said housing thereby maintaining said agitator, said tub and said housing free from movement relative to each other when transporting said machine.

The invention is also directed to a corrugated fiberboard blank for constructing a washing machine packing brace comprising:

a first tuck panel, said first tuck panel extending along one edge via a first fold line into a foldably connected first bottom panel, said first bottom panel extending away from said first tuck panel into a foldably connected first end panel, said first end panel extending away from said first bottom panel into a top panel, said top panel extending away from said first end panel into a second end panel, said second end panel extending away from said top panel into a second bottom panel, said second bottom panel extending away from said second end panel via a second fold line into a second tuck panel, said first tuck panel extending about an edge remote from said first bottom panel into at least one first locking tab, said second tuck panel extending about an edge remote from said second bottom panel into at least one second locking tab, said top panel having at least one elongate aperture for cooperating with said at least one first locking tab and said at least one second locking tab, said first fold line being discontinuous about a first cut out portion extending into said first tuck panel and said first bottom panel, said second fold line being discontinuous about a second cut out portion extending into said second tuck panel and said second bottom panel, whereby when said blank is folded into said packing brace, on folding said first and said second end panel, said first and said second bottom panel and said first and said second tuck panel, said at least one first and said at least one second locking tab are releasably locked by insertion into said at least one elongate aperture, thereby defining said packing brace wherein said first and said second cut out portion cooperate to define a box-like opening within said packing brace, said box-like opening having a depth of less than the depth of said packing brace.

The invention is further directed to a unitary packing brace for washing machines, for maintaining the agitator, tub and housing of the machine free from movement relative to each other when transporting the machine comprising:

a corrugated fiberboard box having a top panel, said top panel extending perpendicularly into a pair of opposite end panels, said opposite end panels extending perpendicularly toward each other into a pair of bottom panels, said pair of bottom panels extending perpendicularly toward said top panel into a pair of juxtaposed tuck panels, said top panel having at least one elongate aperture parallel with said end panels, each of said tuck panels extending remote from said bottom panels into at least one locking tab, said at least one locking tab of each of said tuck panels inserted and thereby releasably locked within said at least one elongate aperture, said pair of bottom panels and their extending tuck panels each having a cut out portion cooperating to define a box-like opening within said packing brace, said box-like opening having a depth less than the depth of said packing brace.

BRIEF DESCRIPTION OF THE DRAWINGS

Referring now to the drawings which illustrate the invention.

Figure 2A:
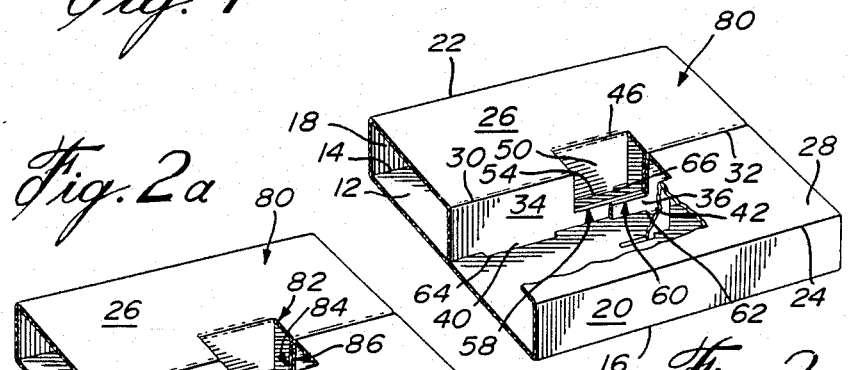
FIG. 2 is a partial perspective view of a packing brace in accordance with an embodiment of the invention.
Figure 2:
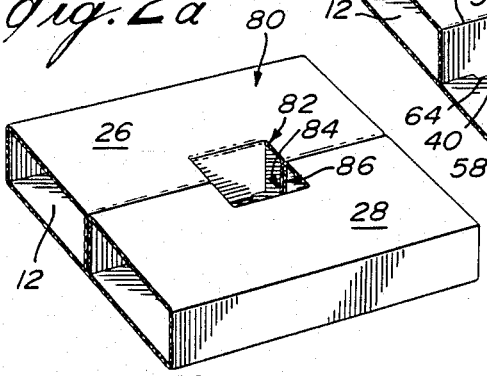

FIG. *2a* is a perspective view of the packing brace as shown in FIG. 2.

Figure 3:
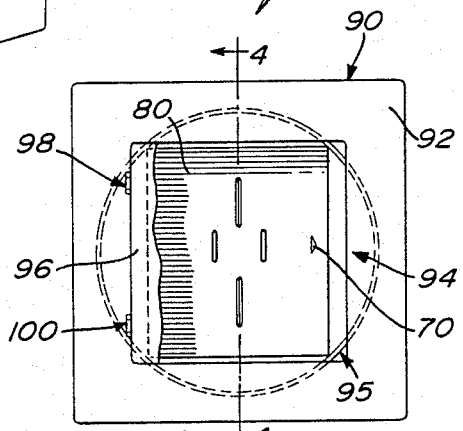

FIG. 3 is a plan view of a packing brace within a washing machine, in accordance with an embodiment of the invention.

Figure 4:
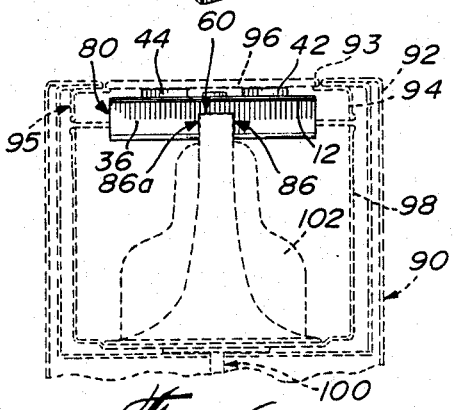

FIG. 4 is a sectional view of a packing brace within a washing machine, in accordance with an embodiment of the invention.

Figure 5:
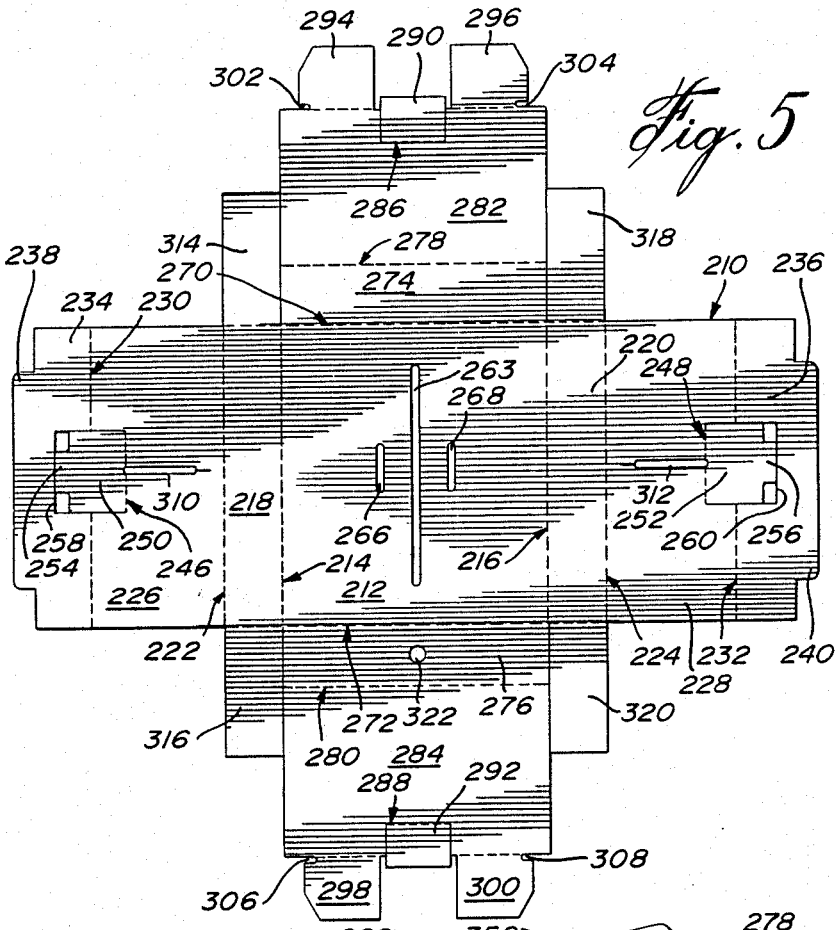

FIG. 5 is a plan view of a blank in accordance with a preferred embodiment of the invention.

Figure 6:
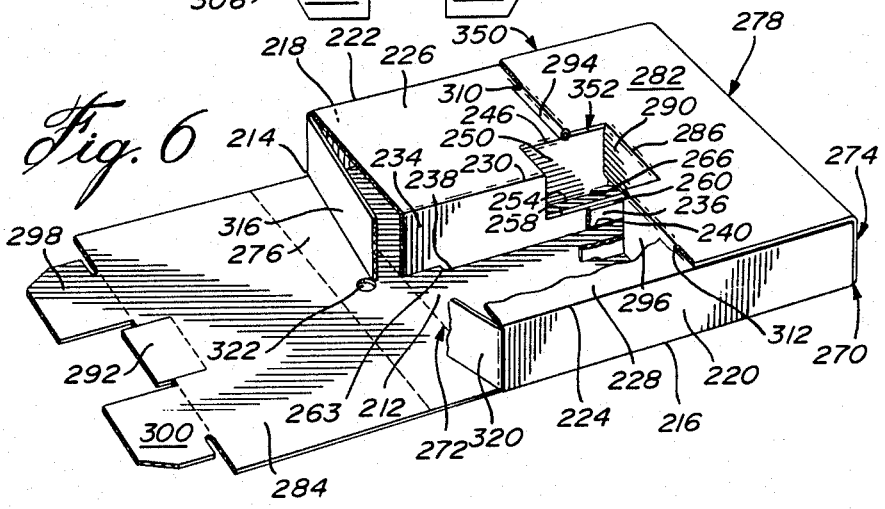

FIG. 6 is a partial perspective view of a blank partially folded to define a packing brace.

FIG. 7 is a perspective view of a packing brace inserted within a washing machine.

FIG. 8 is a sectional view of a packing brace inserted within a washing machine and in accordance with a preferred embodiment of the invention.

Figure 1:
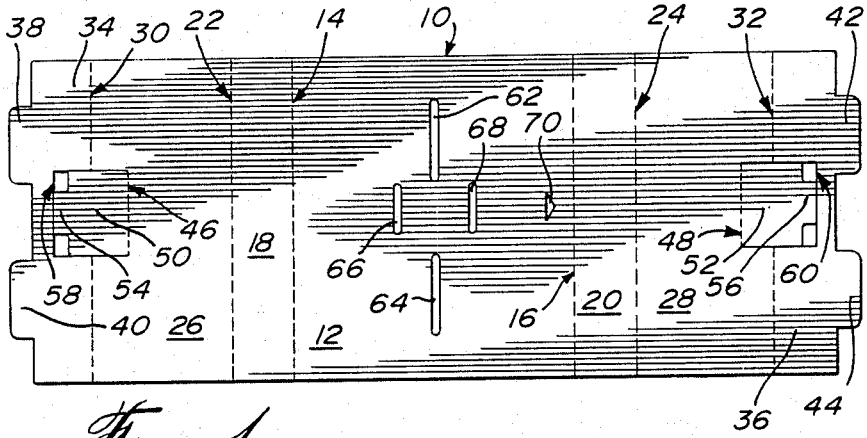
FIG. 1 is a plan view of a blank in accordance with an embodiment of the invention.

Referring now to FIG. 1, there is shown a corrugated fiberboard blank 10 having top panel 12 extending via opposite edges 14,16 into foldably connected end panels 18,20 respectively. End panels 18,20 each extend away from top panel 12 via fold lines 22,24 into foldably connected bottom panels 26,28 respectively. Opposite edges 14,16 and fold lines 22,24 are substantially parallel.

Bottom panels 26,28 each extend away from end panels 18,20 respectively via fold lines 30,32 into tuck panels 34,36 respectively. Each of the tuck panels 34,36 has at least one locking tab extending from an edge remote from bottom panels 26,28. Each tuck panel 34,36 is shown with two locking tabs 38,40 and 42,44 respectively. The locking tabs preferably extend from at least two thirds the length of the above-mentioned remote edge. The fold lines 30,32 are discontinuous thereby allowing for a cut out portion amidst the fold lines 30,32, and not necessarily at the mid portion of fold lines 30,32, the cut out portions extending into bottom panels 26,28 and tuck panels 34,36 respectively. The cut out portions preferably remain foldably connected at fold lines 46,48 defining cushion flaps 50,52, each of which preferably has at least one lock tab 54,56 extending from an edge remote from fold lines 46,48. Cushion flaps 50,52 may be omitted, however, this is less preferred. The cut out portions also define support edges 58,60 parallel to fold lines 30,32 and within tuck panels 34,36.

Top panel 12 has at least one aperture to cooperate with the locking tabs extending from the tuck panels. Blank 10 is shown having apertures 62,64 in top panel 12, to cooperate with locking tabs 38,42 and 40,44 respectively, as will be explained later. Top panel 12 preferably has at least two apertures 66,68 to cooperate with lock tabs 54,56 as will be explained later.

Blank 10 also preferably has a means to indicate its orientation. Such means may be a symbolic aperture, a label, a printed symbol etc., particularly located about one of top panel 12, end panels 18,20 or bottom panels 26,28. In FIG. 1, the means to indicate orientation is shown as triangular aperture 70 in top panel 12.

Referring now to FIG. 2, blank 10 of FIG. 1 is in folded position defining packing brace 80. End panels 18,20 are bent about edges 14,16 respectively, to be perpendicular to top panel 12. Bottom panels 26,28 ae bent about fold lines 22,24, and tuck panels 34,36 are bent about fold lines 30,32 respectively until the tuck panels approach top panel 12. The locking tabs 38,42 and 40,44 (38 and 44 not shown) are inserted into apertures 62,64 respectively, and cushion flaps 50,52 (when present) are bent about fold lines 46,48 and their preferred lock tabs 54,56 inserted into apertures 66,68 respectively. Only cushion flap 50, fold line 46, lock tab 54 and aperture 66 are shown in FIG. 2.

The locking tabs 38,42 and 40,44 are tightly and snugly fitted within apertures 62,64 to releasably lock and thereby maintain the tuck panels 34,36 in substantial contact with and perpendicular to top panel 12. The locking mechanism (each locking tab in its corresponding aperture) may be released if desired, particularly to unfold packing brace 80 into a blank thereby reducing its storage volume until further use.

End panels 18,20, tuck panels 34,36, and cushion flaps 50,52 are all substantially parallel with each other, and are also substantially perpendicular to top panel 12, and bottom panels 26,28.

Referring now to FIG. *2a*, there is shown packing brace 80 of FIG. 2, in its entirety, and actually in an upside down position: bottom panels 26,28 form a bottom surface and top panel 12, a top surface of the packing brace. In the bottom surface, the cut out portions in bottom panels 26,28 form a generally square box-like opening 82 of a predetermined depth. Opening 82 may or may not be centrally located, this being determined by the structure of the individual washing machines the packing brace is to be inserted within.

Support edges 58,60 (see FIG. 2) form a support surface distanced between top panel 12 and bottom panels 26,28 according to the necessary predetermined depth of opening 82. Edges 84,86 (and similarly on opposite side of opening 82) also form a surface prependicular to the above support surface, the function of these surfaces to be defined below.

Referring now to FIG. 3, there is shown a plan view of packing brace 80 inserted into washing machine 90. Washing machine 90 is of the standard upright standing type and the dimensions of packing brace 80 are chosen to accomodate the various models on the market. Washing machine 90 comprises housing 92, load opening 94, cover 96 shown in part only and hinged at 98 and 100. Load opening 94 is generally annular, such as the circle shown, however packing brace 80 can easily be proportioned to be insertable into various shapes of load opening 94.

Packing brace 80 is usually rectangular, preferably square, such that at least four corner edges frictionally abut against the inside rim 95 of load opening 94, whether the latter is circular, oval, partially circular or other. The means to indicate its orientation with respect to washing machine 90, such as triangular aperture 70 in this case pointing towards what will be considered as the front of packing brace 80 and housing 92, enables fast and easy insertion of the brace into load opening 94 according to a predetermined orientation, thereby avoiding a generally lengthy trial and error insertion.

The means to indicate orientation is most practical when the agitator and the corresponding box-like opening in the brace are not centrally located with respect to load opening 94.

Referring now to FIG. 4, there is shown section 4—4 of FIG. 3. Washing machine 90 comprises housing 92 which is formed about its upper portion into a depression 93 which terminates into the rim 95 defining the load opening 94. The cover 96 is fitted into depression 93, and is hinged about an edge to enable cover 96 to open and close load opening 94.

A tub 98, generally with a circular cross-section is fixed to enable rotation and some vibration of tub 98 about vertical axis 100. Agitator 102 is located within tub 98 and is also fixed to enable rotation and some vibration about vertical axis 100, independent or dependent with the motions of tub 98.

Packing brace 80 is inserted into load opening 94, whereby the upper end portion of agitator 102 fits into box-like opening 82: support edges 58, 60 (58 not shown) abut against the upper horizontal surface of agitator 102 while edges 86, 86*a* within tuck panel 36 (and similarly with edges of adjacent hidden tuck panel 34) frictionally abut against opposite substantially vertical surfaces of the upper portion of agitator 102. Unshown fold line 46 and preferred cushion flap 50 (and similarly for opposite fold line 48 and cushion flap 52) are also areas where opposite substantially vertical surfaces of the upper portion of agitator 102 frictionally abut, the latter vertical surfaces being perpendicular to the previously mentioned vertical surfaces and upper horizontal surface of agitator 102.

The bottom surface of the packing brace must be within tub 98 such that the four corners of the packing brace also frictionally abut against the upper inside portion of tub 98 to prevent any movement or vibration of the latter with respect to housing 92.

Thus, the upper portion of agitator 102 being snugly fit within box-like opening 82 of the packing brace, and the latter being snugly fit into load opening 94 and tub 98 of the washing machine prevents any movement or vibration of the agitator and the tub with respect to the housing.

As mentioned above, the bottom surface of packing brace 80 must be within tub 98 a sufficient distance to efficiently brace the tub against movement with respect to housing 92. The top surface of the brace being top panel 12, must be above the lower edge of rim 95 a sufficient distance to effectively hold brace 80 in position.

When brace 80 is fully inserted onto agitator 102, the brace pushes down onto the agitator, preventing the latter to vibrate with respect to the tub. In order to maintain the brace fully inserted and to prevent it from moving upwards, cover 96 is closed and taped or strapped to housing 92 in order to remain closed onto the brace. The locking tabs 42,44 (and 38,40 not shown) which protrude through top panel 12, abut against cover 96, maintaining the brace in position. Alternatively, the locking tabs 42,44 (and 38,40) may not protrude through top panel 12, whereby the top panel itself abuts against cover 96. As cover 96 is often arced, top panel 12 or alternatively the locking tabs may not abut against cover 96 in their entirety.

Another less preferred embodiment of a blank and packing brace thereof can be obtained as follows. A bottom panel extends perpendicularly into a pair of opposite end panels. The end panels extend perpendicularly toward each other into a pair of top panels. The pair of top panels extend perpendicularly toward the bottom panel into a pair of juxtaposed tuck panels. The bottom panel has a cut out portion (circular or square) near or about its mid point. The tuck panels have locking tabs which are snugly inserted into elongate apertures on opposite sides of the cut out portion. The tuck panels have a portion cut away about their edge remote from the adjacent top panels, these portions cut away cooperating with the cut out portion in the bottom panel to define a box-like opening with a depth less than the depth of the packing brace.

PREFERRED EMBODIMENT

Referring now to FIG. 5, there is shown a corrugated fiberboard blank 210 having top panel 212 extending via opposite lateral edges 214,216 into foldably connected end panels 218,220 respectively. End panels 218,220 each extend away from top panel 212 via fold lines 222,224 into foldably connected inner bottom panels 226,228 respectively. Lateral edges 214,216 and fold lines 222,224 are substantially parallel.

Inner bottom panels 226,228 each extend away from end panels 218,220 respectively via fold lines 230,232 into tuck panels 234,236. Each of tuck panels 234,236 has a locking tab 238,240 extending from an edge remote from inner bottom panels 226,228. Locking tabs 238,240 are most preferably at least two thirds the length of tuck panels 234,236 respectively. The fold lines 230,232 are discontinuous thereby allowing for a substantially rectangular cut out portion amidst them, the cut out portion extending into inner bottom panels 226,228 and adjacent tuck panels 234,236 respectively. The cut out portions may separate each fold line 230,232 into equal or unequal lengths.

The cut out portions remain foldably connected at fold lines 246,248 defining cushion flaps 250,252, each having a lock tab 254,256 extending from an edge opposite from fold lines 246,248. The cut out portions also provide support edges 258,260, within tuck panels 234,236 and substantially parallel to fold lines 230,232 respectively.

Top panel 212 has an elongate aperture 263 to cooperate with locking tabs 238,240 respectively, as will be explained later. Top panel 212 also has apertures 266,268 to cooperate with lock tabs 254,256 respectively.

Top panel 212 also extends via opposite longitudinal edges 270,272 into foldably connected side panels 274,276 respectively. Sice panels 274,276 each extend away from top panel 212 via fold lines 278,280 into foldably connected outer bottom panels 282,284 respectively.

Each outer bottom panel 282,284 has a rectangular cut out portion which preferably remains foldably connected at fold lines 286,288 within the outer bottom panels. The cut out portions define cushion panels 290,292 which may extend beyond the outer edge of the outer bottom panels as shown.

Each outer bottom panel 282,284, about an edge remote from side panels 274,276, and on either side of cushion panels 299,292, extends into a foldably connected lock flap 294,296 and 298,300 respectively. Each of the lock flaps preferably has a pye lock 302,304,306,308, to be explained later.

Inner bottom panels 226,228 have elongate apertures 310,312, which will cooperate with lock flaps 294,298 and 296,300 respectively. Apertures 310,312 preferably have a lock slit about one end, to cooperate with the pye locks of the lock flaps. Each of end panels 218,220 preferably extends about opposite edges into foldably connected inner flaps 314,316 and 318,320 respectively.

Blank 210 preferably has a means to indicate its orientation, such as a symbolic aperture, a printed symbol, a label, particularly located about one of top panel 212, end panels 218,220, side panels 274,276 and outer bottom panels 282,284. The means to indicate orientation is shown as aperture 322 in side panel 276.

Referring now to FIG. 6, blank 210 of FIG. 5 is in partially folded position defining partially folded packing brace 350. End panels 218,220 are bent about lateral edges 214,216 respectively, to be perpendicular to top panel 212. Inner bottom panels 226,228 are bent about fold lines 222,224, and tuck panels 234,236 are bent about fold lines 230,232 respectively until the tuck panels approach top panel 212 (fold line 232 is not shown). The locking tabs 238,240 are inserted into elongate aperture 263, and cushion flaps 250,252 are bent about fold lines 246,248 and their lock tabs 254,256 inserted into apertures 266,268 respectively. Only cushion flap 250, fold line 246, locking tab 254 and aperture 266 are shown in FIG. 6.

The locking tabs 238,240 are tightly and snugly fitted within aperture 263 to releasably lock and thereby maintain the tuck panels 234,236 in substantial contact with and perpendicular to top panel 212.

Inner flaps 314,318 (not shown) and 316,320 are folded until each pair is vis-a-vis each other and longitudinal edges 270 (not shown) and 272 respectively. Side panel 274 is bent about longitudinal edge 270, to be perpendicular to top panel 212. Outer bottom panel 282 is bent about fold line 278, and lock flaps 294,296 are bent until they respectively approach apertures 310,312 in inner bottom panels 226,228. The lock flaps are inserted into apertures 310,312 and their pye locks and lock slits cooperate to provide a releasably locking assembly which will not unlock unless purposely forced to unlock.

Cushion panel 290 is bent, about fold line 286, inwardly into generally square box-like opening 352 formed within packing brace 350. The folding of the packing brace would be completed by similarly folding side panel 276, outer bottom panel 284, lock flaps 298,300, and cushion panel 292, and finally inserting lock flaps 298,300 into apertures 310,312 respectively.

The final product, when fully folded, is a rectangular packing brace having a bottom surface formed by outer bottom panels 282,284, and a top surface formed by top panel 212. Within the bottom surface is a generally square box-like opening 352, the depth of the opening being determined by support edges 258,260 which are spaced between the top and bottom surfaces of the packing brace.

Lock flaps 294,296,298,300 preferably abut against top panel 212 and against cushion panels 250,252 to increase the strength of the brace near opening 352.

Referring now to FIG. 7, there is shown a perspective view of packing brace 350 inserted into washing machine 390 which comprises housing 392, load opening 394, cover 396 shown in part only and hinged at 398 and 400. Load opening 394 is generally circular and packing brace 350 inserted within is rectangular, preferably square, with its four corners frictionally engaging against the inside rim 395 of load opening 394.

The means to indicate orientation, aperture 322, is shown to point towards the front of the washing machine.

Referring now to FIG. 8, there is shown section 8—8 of FIG. 7. Washing machine 390 comprises housing 392 which is formed about its upper portion into a depression 393 which terminates into the rim 395 defining the load opening 394. The cover 396 is fitted into depression 393, and is hinged about an edge to enable cover 396 to open and close load opening 394.

A cylindrical tub 398 is fixed to enable rotation and some vibration of tub 398 about a central vertical axis. Agitator 402 is located within tub 398 and is also fixed to enable rotation and some vibration about the central vertical axis, independent or dependent with the motions of tub 398.

Packing brace 350 is inserted into load opening 394, whereby the upper end portion of agitator 402 fits into square box-like opening 352: support edges 258,260 abut against the upper horizontal surface of agitator 402 while the four cushion panels defining the side walls of box-like opening 352 frictionally abut against the substantially vertical surfaces of the upper portion of agitator 402.

The bottom surface of the packing brace is within tub 398 a sufficient distance such that the four corners of the packing brace also frictionally abut against the upper inside portion of tub 398 to prevent any movement or vibration of the latter with respect to housing 392. The top surface of the brace being top panel 212, is above the lower edge of rim 395 a sufficient distance to effectively hold brace 350 in position.

When brace 350 is fully inserted onto agitator 402, the brace pushes down onto the agitator, preventing the latter to vibrate with respect to the tub. In order to maintain the brace fully inserted and to prevent it from moving upwards, cover 396 is closed and taped or strapped to housing 392 in order to maintain closed onto the brace. The locking tabs 238,240 protrude through top panel 212, abut against cover 396 and maintain the brace in position. Alternatively the locking tabs 238,240 may not protrude through top panel 212, whereby the top panel itself abuts against cover 396. As cover 396 is often arced, top panel 212 or alternatively the locking tabs may not abut against cover 396 in their entirety.

Packing brace 350 offers additional strength in the box-like opening 352 surrounding the upper portion of agitator 402. Also, lock flaps 294,296 increase the strength of the brace near its mid portion, preventing it from caving inwardly if compressed unusually by agitator 402 while the machine is being transported. The brace, being made of corrugated fiberboard, is rigid yet still has sufficient yield to provide a cushioning effect to the braced inner parts when the washing machine is subjected to vibration, transport or sudden shocks.

Having described the invention, modifications will be evident to those skilled in the art without departing from the spirit of the invention, as defined in the appended claims.

What is claimed is:

1. A unitary packing brace for washing machines, for maintaining the agitator, tub and housing of the machine free from movement relative to each other when transporting the machine comprising:

a corrugated fiberboard box having a top surface and a bottom surface, said top surface and said bottom surface being substantially parallel and including a means to maintain said top surface and said bottom surface in spaced relationship, said box through said bottom surface, having a box-like opening, said box-like opening having a bottom-like surface parallel to said top surface and spaced between and away from said top surface and said bottom surface, whereby when said packing brace is inserted into said washing machine through its load opening, said box-like opening fits onto and cooperates with said agitator, said bottom-like surface being supported by the top end of said agitator, and said box adapted to snugly engage against the rim of said tub and said housing thereby maintaining said agitator, said tub and said housing free from movement relative to each other when transporting said machine.

2. The packing brace as defined in claim 1 wherein said means to maintain said top surface and said bottom surface in spaced relationship includes at least four corner edges extending between said bottom surface and said top surface to snugly engage against said rim and said housing, and thereby cooperate with said top surface, said bottom surface, and said box-like opening in maintaining said agitator, said tub and said housing free from movement relative to each other when transporting said machine.

3. The packing brace as defined in claim 1 whereby upon insertion of said packing brace into said washing machine, at least a portion of said top surface abuts against at least a portion of a cover closing said load opening.

4. The packing brace as defined in claim 1 wherein said top surface has at least one projection extending away from said bottom surface, whereby upon insertion of said packing brace into said washing machine, at least a portion of said at least one projection abuts against at least a portion of a cover closing said load opening.

5. The packing brace as defined in claim 1 including a means to indicate orientation of said packing brace with respect to said washing machine.

6. A corrugated fiberboard blank for constructing a washing machine packing brace comprising:

a first tuck panel, said first tuck panel extending along one edge via a first fold line into a foldably connected first bottom panel, said first bottom panel extending away from said first tuck panel into a foldably connected first end panel, said first end panel extending away from said first bottom panel into a top panel, said top panel extending away from said first end panel into a second end panel, said second end panel extending away from said top panel into a second bottom panel, said second bottom panel extending away from said second end panel via a second fold line into a second tuck panel, said first tuck panel extending about an edge remote from said first bottom panel into at least one first locking tab, said second tuck panel extending about an edge remote from said second bottom panel into at least one second locking tab, said top panel having at least one elongate aperture for cooperating with said at least one first locking tab and said at least one second locking tab, said first fold line being discontinuous about a first cut out portion extending into said first tuck panel and said first bottom panel, said second fold line being discontinuous about a second cut out portion extending into said second tuck panel and said second bottom panel, whereby when said blank is folded into said packing brace, on folding said first and said second end panel, said first and said second bottom panel and said first and said second tuck panel, said at least one first and said at least one second locking tab are releasably locked by insertion into said at least one elongate aperture, thereby defining said packing brace wherein said first and said second cut out portion cooperate to define a box-like opening within said packing brace, said box-like opening having a depth of less than the depth of said packing brace.

7. The blank as defined in claim 6 having one first locking tab and one second locking tab, wherein said first and said second locking tab are at least two thirds the length of said edge remote from said first bottom panel.

8. The blank as defined in claim 6 wherein said first cut out portion remains foldably connected about one edge parallel to said first fold line and within said first bottom panel, whereby upon folding, said first cut out portion remaining foldably connected defines a first side wall of said box-like opening, and wherein said second cut out portion remains foldably connected about one edge parallel to said second fold line and within said second bottom panel, whereby upon folding, said second cut out portion remaining foldably connected defines a second side wall of said box-like opening, opposite said first side wall, said first cut out portion remaining foldably connected extends remote from its foldably connected edge into a first lock tab, said second cut out portion remaining foldably connected extends remote from its foldably connected edge into a second lock tab, said top panel has two apertures, whereby upon folding, said first lock tab is inserted into a first of said two apertures and thereby releasably locked, and said second lock tab is inserted into a second of said two apertures and thereby releasably locked.

9. The blank as defined in claim 6 wherein said top panel has a pair of opposite free edges, said top panel extending about said opposite free edges into side panels, said side panels extending away from said top panel into outer bottom panels, a first of said outer bottom panels having a first cut out panel foldably connected within and extending about an edge remote from said side panels, a second of said outer bottom panels having a second cut out panel foldably connected within and extending about an edge remote from said side panels, said first of said outer bottom panels extending about its said edge remote from said side panels into a first and a second foldably connected lock flap, said second of said outer bottom panels extending about its said edge remote from said side panels into a third and a fourth foldably connected lock flap, said first bottom panel having a first aperture and said second bottom panel having a second aperture, whereby upon folding said side panels, said outer bottom panels, said first and said second cut out panel, and said first, said second, said third and said fourth lock flap, said first and said third lock flap are inserted into said first aperture and said second and said fourth lock flap are inserted into said second aperture thereby releasably locking said lock flaps and defining said packing brace wherein said first cut out panel defines a third side wall of said box-like opening, and said second cut out panel defines a fourth side wall of said box-like opening, opposite said third side wall and perpendicular to said first and said second side wall.

10. The blank as defined in claim 9 including a means to indicate orientation.

11. The blank as defined in claim 10 wherein said means to indicate orientation is one of the group comprising a symbolic aperture, a printed symbol, a label on one of the group comprising said top panel, said first end panel, said second end panel, said side panels and said outer bottom panels.

12. A unitary packing brace for washing machines, for maintaining the agitator, tub and housing of the machine free from movement relative to each other when transporting the machine comprising:

a corrugated fiberboard box having a top panel, said top panel extending perpendicularly into a pair of opposite end panels, said opposite end panels extending perpendicularly toward each other into a pair of bottom panels, said pair of bottom panels extending perpendicularly toward said top panel into a pair of juxtaposed tuck panels, said top panel having at least one elongated aperture parallel with said end panels, each of said tuck panels extending remote from said bottom panels into at least one locking tab, said at least one locking tab of each of said tuck panels inserted and thereby releasably locked within said at least one elongate aperture, said pair of bottom panels and their extending tuck panels each having a cut out portion cooperating to define a box-like opening within said packing brace, said box-like opening having a depth less than the depth of said packing brace.

13. The packing brace as defined in claim 12 wherein said at least one locking tab of each said tuck panels protrude beyond said top panel.

14. The packing brace as defined in claim 12 including a cushion panel foldably connected to an edge of each of said cut out portion within each of said bottom panels, each of said cushion panel extending into a lock tab cooperating with an aperture in said top panel to releasably lock said cushion panel parallel to said end panels.

15. The packing brace as defined in claim 12 including said top panel extending perpendicularly into a pair of opposite side panels, said side panels extending perpendicularly toward each other into outer bottom panels, said outer bottom panels being juxtaposed with said bottom panels, each of said bottom panels having an aperture parallel to said side panels, each of said outer bottom panels extending into a pair of foldably connected lock flaps, a first of said pair of lock flaps inserted and thereby releasably locked into said aperture in each of said bottom panels, a second of said pair of lock flaps inserted and thereby releasably locked into said aperture in each of said bottom panels, a cut out panel in each of said outer bottom panels is folded inwardly into and cooperates with said box-like opening.

16. The packing brace as defined in claim 15 wherein each of said end panels extends perpendicularly and on the inside of said side panels into a pair of opposed end flaps.

17. The packing brace as defined in claim 12 including a means to indicate orientation.

18. The packing brace as defined in claim 17 wherein said means to indicate orientation is one of the group comprising a symbolic aperture, a printed symbol and a label on one of the group comprising said top panel, said end panels and said bottom panels.

19. The packing brace as defined in claim 15 including a means to indicate orientation.

20. The packing brace as defined in claim 19 wherein said means to indicate orientation is one of the group comprising a symbolic aperture, a printed symbol and a label on one of the group comprising said top panel, said end panels, said side panels and said outer bottom panels.

* * * * *